US005737980A

United States Patent [19]

Keith et al.

[11] Patent Number: 5,737,980

[45] Date of Patent: Apr. 14, 1998

[54] BRAZING RECEPTACLE FOR IMPROVED PCD CUTTER RETENTION

[75] Inventors: Carl W. Keith, Spring; Gary R. Chunn, Conroe; Mark A. Johnson, Montgomery, all of Tex.

[73] Assignee: Smith International, Inc., Houston, Tex.

[21] Appl. No.: 658,056

[22] Filed: Jun. 4, 1996

[51] Int. Cl.[6] ..... E21B 10/46

[52] U.S. Cl. ..... 76/108.2; 29/527.5; 29/527.6; 76/DIG. 12; 164/98

[58] Field of Search ..... 76/108.1, 108.2, 76/108.4, 108.6, DIG. 11, DIG. 12; 29/527.5, 527.6, 527.1, 530; 164/98; 175/426, 434, 435

[56] References Cited

U.S. PATENT DOCUMENTS

| | | | |
|---|---|---|---|
| 4,499,795 | 2/1985 | Radtke | 76/DIG. 12 |
| 4,683,781 | 8/1987 | Kar et al. | 76/108.2 |
| 4,694,919 | 9/1987 | Barr | 76/DIG. 11 |
| 5,119,714 | 6/1992 | Scott et al. | 76/108.2 |
| 5,179,994 | 1/1993 | Kuhn | 164/98 X |
| 5,355,750 | 10/1994 | Scott et al. | 76/DIG. 12 |

FOREIGN PATENT DOCUMENTS 284579 9/1988 European Pat. Off. .

*Primary Examiner*—Douglas D. Watts
*Attorney, Agent, or Firm*—Christie, Parker & Hale, LLP

[57] ABSTRACT

Thin walled metal alloy receptacles are filled with a filler material. If granular, the filler material is solidified in the receptacles. The receptacles are inserted in a bit mold with their open ends abutting against preformed cutter locations in the bit mold. The mold is filled with a steel or tungsten carbide powder and a binder and exposed to temperatures sufficient to cause the binder to infiltrate the steel or tungsten carbide as well as infiltrate the receptacle outer surfaces, metallurgically bonding the receptacles to the binder. The mold is then removed, revealing a bit body with the bonded filled receptacles. The filler material is removed from the receptacles PCD cutters are inserted in the receptacles and are brazed using conventional brazing techniques.

15 Claims, 6 Drawing Sheets

BRAZING RECEPTACLE FOR IMPROVED PCD CUTTER RETENTION

BACKGROUND OF THE INVENTION

The present invention relates to polycrystalline diamond (PCD) cutter bits and more specifically, it relates to cutter bits wherein their cutter cavities are lined with a thin walled receptacles providing a bonding interface between the cutter and the bit body. The invention also relates to a method for forming such a bit.

PCD cutter bits have a plurality of cavities around their body to accommodate the PCD cutters. These cutters are inserted into these cavities and are brazed to the "matrix material" steel or tungsten carbide bit body. The bond formed between the cutter and the bit body may be the weak link in a PCD cutter bit. It is a primary reason for cutter loss.

The bit body cavities are typically formed by graphite displacements placed in a mold which is used to form the bit. The displacements are removed after the bit body is sintered or infiltrated, revealing the bit body cavities. These cavities may have a poor quality surface finish which is sometimes also geometrically irregular. The irregularity of the surface geometry is caused by insufficient packing of powdered matrix material around the displacements. The degree of geometry irregularity and the quality of the surface finish varies from bit to bit. These inconsistencies in the cavity surface finish and geometry may result in a poor braze and a relatively weak bond between the PCD cutters and the bit body.

When this braze bond fails, the cutter falls out of the bit. The fallen cutter may get jammed against the bit, causing further bit damage. To reduce the risk of further bit damage, once cutters fall out, the drilling operation is stopped and the bit is retrieved from the bore and replaced. This is a timely and costly venture.

Accordingly, there is a need for a PCD cutter bit which is formed with cavities having a consistently improved quality surface finish and surface geometry improving the quality of the bond between the PCD cutter and the bit body leading to enhanced cutter retention.

SUMMARY OF THE INVENTION

This invention relates to a method for forming a PCD cutter bit body having its cutter cavities lined with thin walled receptacles made from a metal alloy, a bimetal alloy or a layered alloy. The thin walled receptacles are filled with filler material such as sand or clay coated with a resin and exposed to heat for melting the resin and setting the material hard. This hardened material serves as a support for the receptacle walls. The receptacles are then inserted with their open ends first in preformed cutter locations in a bit mold. The mold is filled with a steel or tungsten carbide powder and a binder or matrix alloy and exposed to temperatures sufficient to cause the binder to infiltrate the steel or tungsten carbide as well as infiltrate to the receptacle outer surfaces metallurgically bonding the receptacles to the binder. Afterwards, the mold is removed, revealing a bit body with filler filled receptacles. The filler material which serves to support the receptacle walls during the bit forming process is then removed. Any deformation of the receptacle walls is straightened using a bullet shaped reformer tool. PCD cutters are then inserted in the receptacles and are brazed using conventional brazing techniques.

BRIEF DESCRIPTION OF THE DRAWINGS

The figures contained herein are for descriptive purposes and may not be to scale.

DETAILED DESCRIPTION

Figure 1:
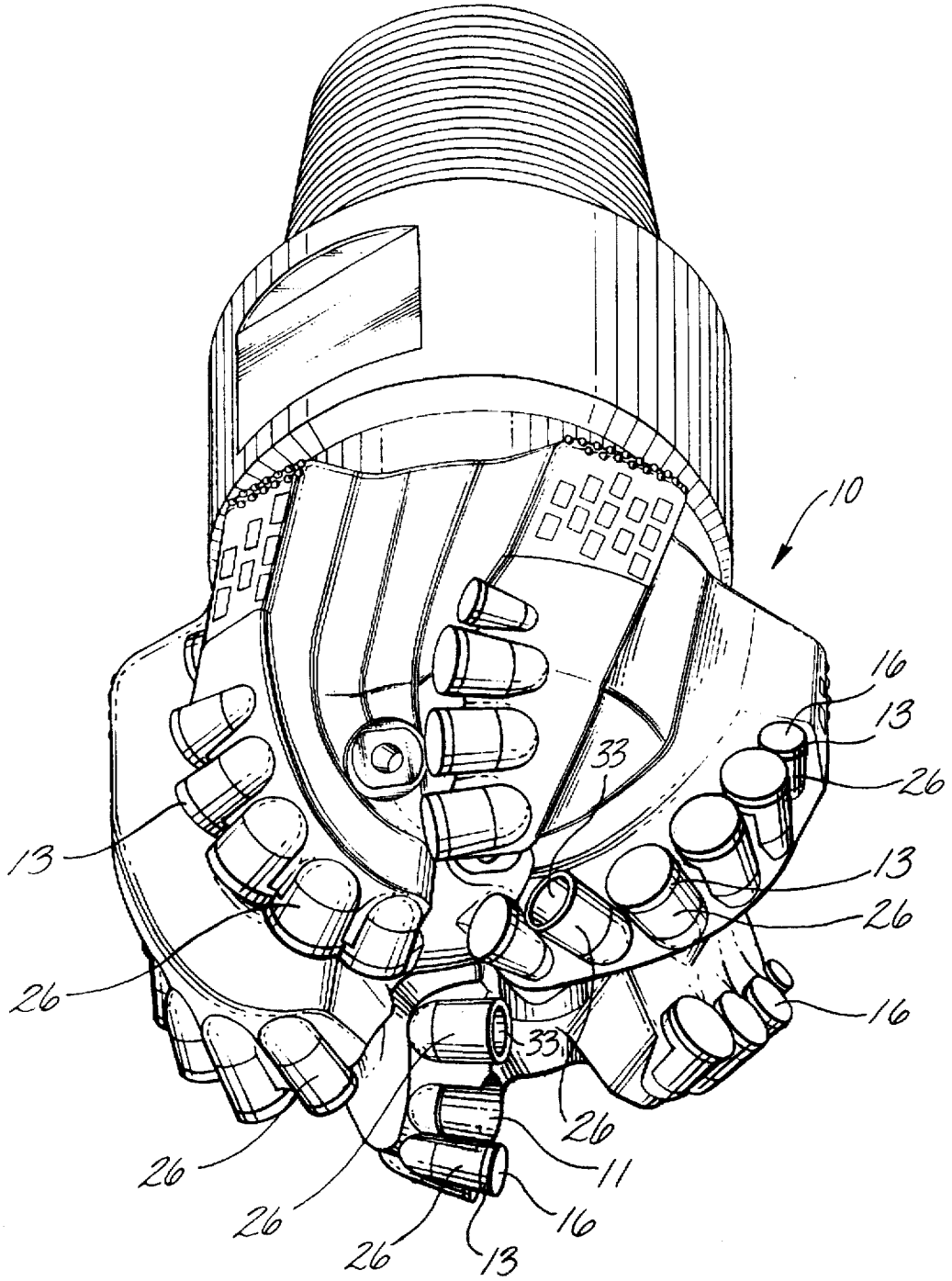
FIG. 1 is an isometric view of a PCD bit having mrs cavities lined with brazing receptacles and PCD cutters inserted therein.
Figure 2:
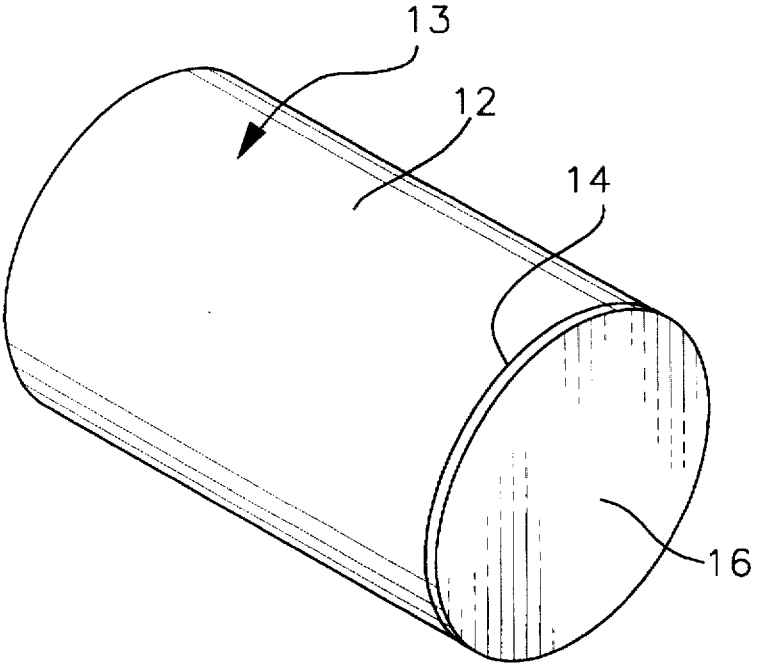
FIG. 2 is an isometric view of a PCD cutter.
Figure 3:
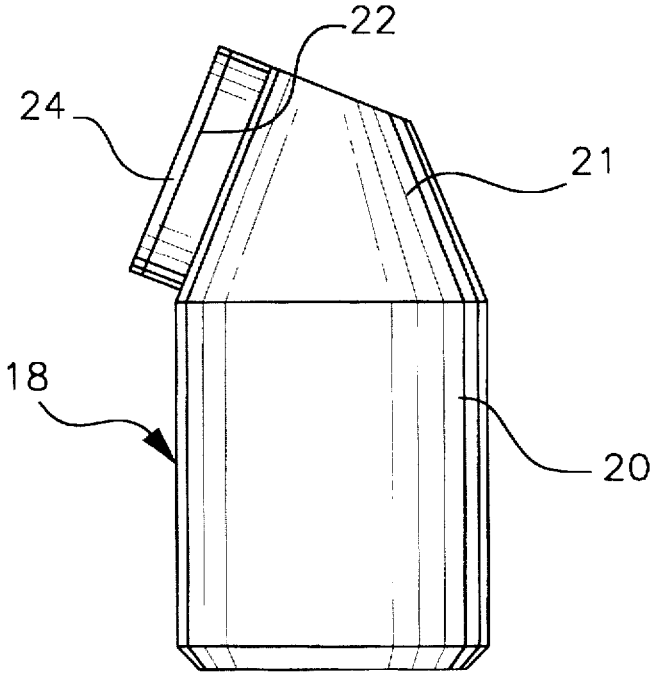
FIG. 3 is a side view of a vertically mounted stud-type cutter.

A polycrystalline diamond (PCD) cutter bit body 10 is formed having cavities 11 lined with thin walled receptacles 26 (FIG. 1). PCD cutters 13 are brazed in these receptacles. PCD cutters, as shown in FIG. 2, have a generally cylindrical cemented tungsten carbide body 12 having a cutting face 14. A PCD layer 16 is sintered on the cutting face of the cutter in a conventional manner. A vertically mounted stud-type cutter 18, shown in FIG. 3, is a different variety of PCD cutter. It has a generally cylindrical carbide body lower section 20 and a generally trapezoidal upper section 21. The cutting face 22 of the cutter is formed on a side of the cutter upper section. A PCD layer 24 is also sintered on the cutting face of the cutter. Such cutters are well known and commercially available.

Figure 4A:
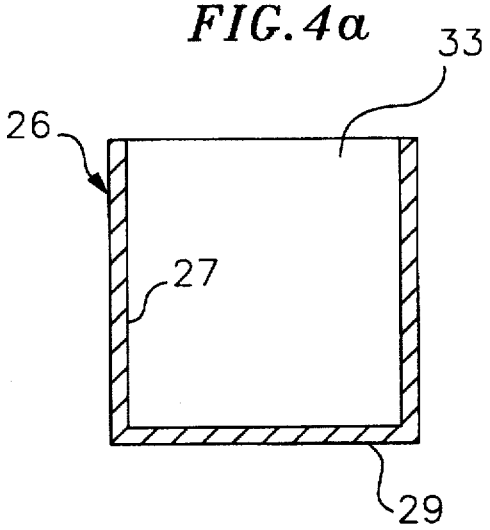
FIG. 4*a* is a cross-sectional view of a brazing receptacle.
Figure 4B:
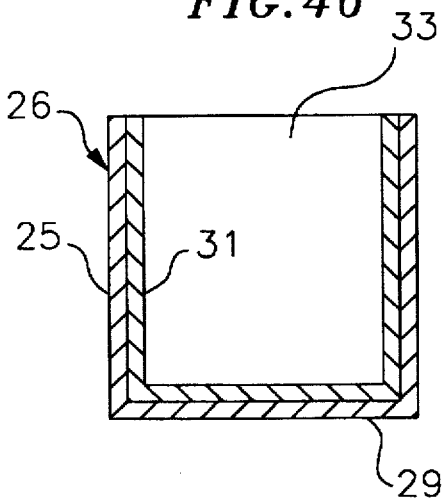
FIG. 4*b* a is a cross-sectional view of a layered alloy brazing receptacle comprising two layers.

A receptacle 26 (FIG. 4*a*) is pressed into a generally cylindrical cup shape and may be made of a metal alloy, or other ferrous or nonferrous materials which have a melting temperature which is higher than the bit infiltrating temperature. Moreover, the receptacle may be made from a bimetal alloy or a layered alloy, as shown in FIG. 4*b*. In a preferred embodiment, the receptacle has a wall thickness of approximately 0.2 mm.

Figure 5:
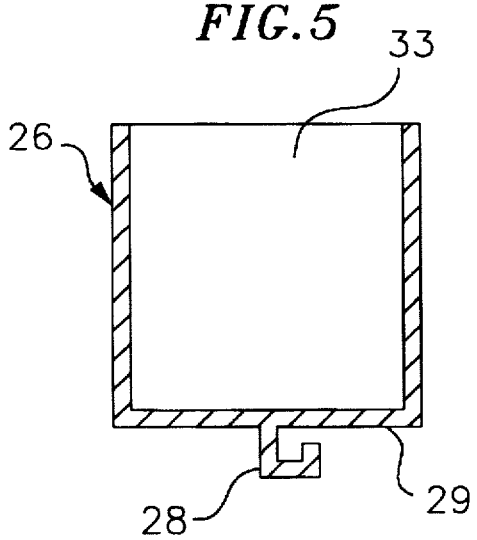
FIG. 5 is a cross-sectional view of a brazing receptacle having an anchor.

In an alternate embodiment, the receptacle 26 has an anchor 28 extending from its base 29, as shown in FIG. 5. Although the anchor shown in FIG. 5 extends through the bottom of the receptacle, the anchor may extend from other areas of the receptacle, e.g., a receptacle side. The anchor provides a securing means for securing the receptacle on the bit body. Typically the anchor is hook shaped as shown in FIG. 5. However, other shapes, which would be apparent to one skilled in the art may also be used. For example, the anchor may be "T" shaped or button shaped or may be any extrusion from the base of the receptacle outer surface.

Figure 8A:
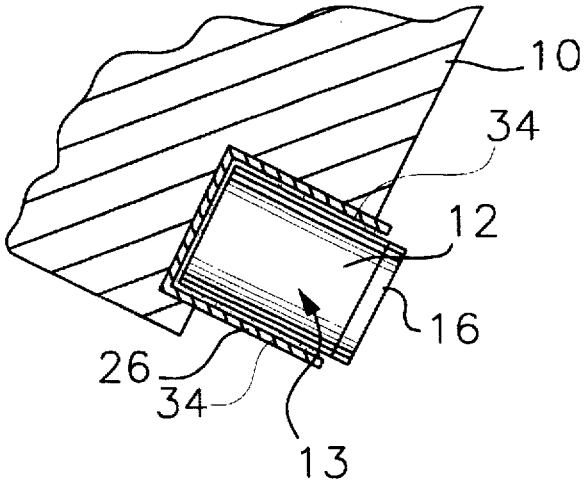
FIG. 8*a* is a fragmentary cross-section view of a section of a PCD bit formed with a brazing receptacle having a PCD cutter brazed therein.
Figure 8B:
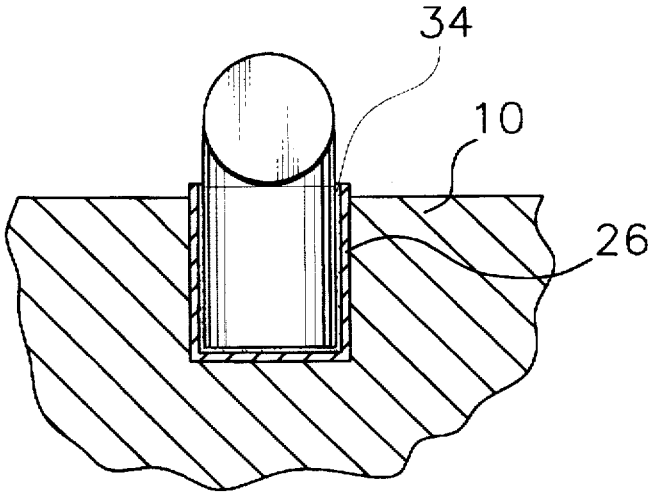
FIG. 8*b* is a fragmentary cross-sectional view of a section of a vertically mounted stud-type cutter bit formed with a filled brazing receptacle having a vertically mounted stud-type cutter brazed therein.

The inner surfaces of the receptacle are dimensioned to allow a braze layer 34 with a thickness of approximately 50 to 125 micrometers to be formed between the receptacle and a cutter during the brazing process, as shown in FIGS. 8*a* and 8*b*. The length of the receptacle is such that when a PCD cutter is inserted in the receptacle, the PCD layer protrudes beyond the receptacle walls as shown in FIGS. 8*a* and 8*b*.

In a preferred embodiment, the receptacles are formed from steel or nickel. Nickel or steel have a very high melting temperature, maintain a rigid shape even when pressed very thin and have excellent wetability and bonding characteristics for the matrix infiltrant and for braze alloys.

By forming the receptacles from a bimetal alloy or a layered alloy, as shown in FIG. 4*b*, the receptacles may be tailored for better brazing and infiltration. For example, by making the receptacle of a layered alloy of steel and nickel with the steel forming the exterior layer 25 and the nickel forming the interior layer 27, the receptacle will have the superior infiltration properties of the steel on its outer surface and the superior brazing properties of the nickel on its inner surface. It should be noted that other materials can be used to form the layered alloys. Moreover, these alloys can comprise more than two alloys or layers. As it will become apparent to one skilled in the art, it is beneficial for the outermost layer to be formed from an infiltration compatible material while the inner layer is made from brazing compatible material.

In an alternate embodiment, receptacles may be formed from an infiltration compatible material, e.g., steel, with their inner surface 31 lined with a brazing compatible coating. For example, a nickel coating may be used.

Figure 6A:
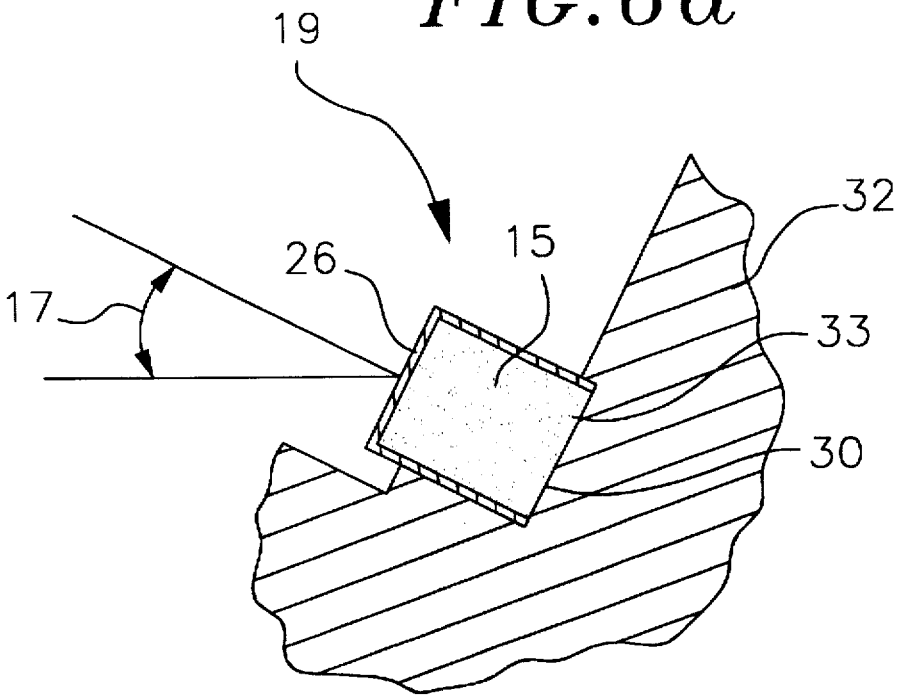
FIG. 6*a* is a fragmentary cross-sectional view of a section of a mold used for forming a PCD bit with a filled brazing receptacle placed in a preformed cutter location within the mold.

Once formed, the receptacles are filled with a filler material, preferably clay or sand to provide support to the receptacle walls so as to maintain the receptacle shape during the infiltration process. Again, other filler materials, e.g., graphites, may be used. These materials can preferably be granular but solid materials can also be used. If granular, the filler material is coated with a resin. By heating the granular filler material filled receptacles, the resin melts, fusing the filler material granules together into a hard material 15 (FIGS. 6*a*, 6*b*, 7*a*, 7*b*). The filled receptacles are then placed in preformed cutter locations 30 in a bit mold 32, with their open ends 33 abutting against the mold as shown in FIG. 6*a*, just as standard graphite displacements have been used when forming conventional PCD cutter bits.

Figure 6B:
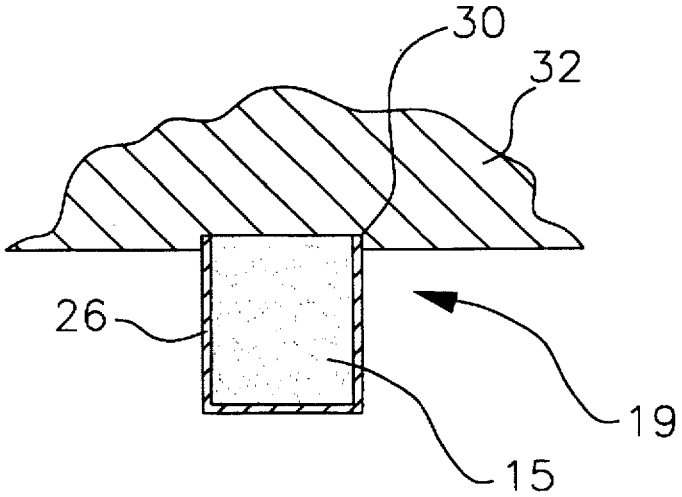
FIG. 6*b* is a fragmentary cross-sectional view of a section of a mold used for forming a vertically mounted stud-type cutter bit with a filled brazing receptacle placed in a preformed cutter location within the mold.

PCD cutters are typically mounted at a rake angle on the bit body as shown in FIG. 1. Thus, the receptacles accommodating them are also positioned at the same rake angle 17 in the bit, as shown in FIG. 6*a*. Vertically mounted stud-type cutters, however, are mounted vertically in the bit body and, therefore, their receptacles are also positioned vertically on the bit body as shown in FIG. 6*b*. Note that FIGS. 6*a* and 6*b* show a portion of the mold and are not to scale.

A powdered steel or tungsten carbide is poured into the mold space 19 surrounding the exposed outer surfaces of the inserted filled receptacles. A matrix or binder alloy is either mixed with the powdered material, or is placed on top of the powdered material in the mold. The mold is then exposed to a high temperature sufficient to melt the binder or matrix alloy which infiltrates the powdered material forming the bit body. Consequently, the binder infiltrates to the outer surfaces of the receptacles, wetting their surfaces and causing them to strongly bond to the binder and in turn to the steel or tungsten carbide of the bit body.

In the alternate embodiment, where a receptacle having an anchor (FIG. 5) is used, the anchor is surrounded by the steel or tungsten carbide and is also infiltrated by the binder causing it to form a strong bond with the binder. As a result, the anchor provides an additional means of securing the receptacle to the bit body.

Figure 7A:
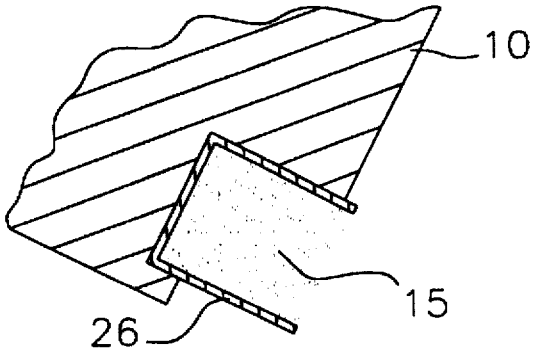
FIG. 7*a* is a fragmentary cross-section view of a section of a PCD bit formed with a filled brazing receptacle.
Figure 7B:
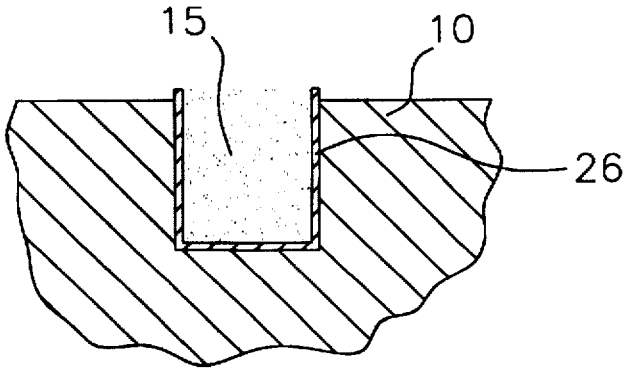
FIG. 7*b* is a fragmentary cross-sectional view of a section of a vertically mounted stud cutter bit formed with a filled brazing receptacle.

Once the bit body 10 has been infiltrated, the mold is removed exposing the bit body, which surrounds a portion of the filled receptacles, and exposing the receptacles' open ends, as shown in FIG. 7*a*. In bits formed to accommodate vertically mounted stud-type cutters, the bit body surrounds each receptacle almost completely as shown in FIG. 7*b*. It should be apparent from the drawings that FIGS. 7*a* and 7*b* are for illustrative purposes and are not to scale.

If a granular filler material coated with a resin is used, the high curing temperature decomposes the resin destroying the bond formed between the filler material granules. As a result, the filler material particles can easily be removed from the receptacles. If solid filler material is used, the solid fillers are pulled out of the receptacles.

If a receptacle is deformed during the infiltration process, a bullet-shaped reformer tool (not shown) may be used to reform the receptacle by sliding the bullet-shaped tool into the receptacle.

Once the filler material is removed and the receptacles are reformed if necessary, the receptacles are prepared for brazing with the PCD cutters. Typically, brazing material may be placed into the receptacles followed by insertion of the PCD cutters. The cutters are then brazed to the receptacles using standard or automated brazing processes. Alternatively, PCD cutters may be placed in the receptacles and brazed with a torch, with braze alloy applied from the outside. Consequently, a portion of the PCD cutters are encapsulated by the receptacles and by a layer of brazing material. The portion of the receptacles exposed outside of the bit body may be removed, but such removal is not necessary.

As discussed earlier the receptacles are dimensioned so that a braze layer 34 with a thickness of approximately 50 to 125 microns thickness is formed between the receptacles 26 and the cutters 13, 18, as shown in FIGS. 8*a* and 8*b*, respectively. A braze layer thickness of about 75 microns is preferred. As is apparent, FIGS. 8*a* and 8*b* are for illustrative purposes and are not to scale.

Since they are pressed into shape and not formed by a mold, the receptacles have an excellent quality inner surface finish for brazing. Moreover, any deformations in the receptacle geometry can be easily corrected using the reformer tool. As a result use of the receptacles provides a consistent quality surface finish and geometry and, thus, provides for an improved braze quality. In addition, coating of the receptacle inner surfaces with a brazing compatible material further improves the brazing quality. The improvement in braze quality allows for the formation of a superior bond between the PCD cutters and the receptacles which is stronger than the braze bond formed between the PCD cutters and bit body cavities formed by conventional molding. Furthermore, use of these receptacles results in a strong bond between the receptacles and the matrix or binder of the bit body. This bond is superior to the conventional braze bond between the cutters and the bit body cavities since it is formed by the infiltration of the binder or matrix. A bond formed by infiltration with a binder is not as detrimentally sensitive to irregularities in the cavity surface finish and geometry as is a bond formed by brazing.

Although this invention has been described in certain specific embodiments, many additional modifications and variations will be apparent to those skilled in the art. It is, therefore, to be understood that within the scope of the appended claims, this invention may be practiced otherwise than as specifically described.

What is claimed is:

1. A method for forming a PCD cutter bit body comprising the steps of:

filling a metal alloy thin walled receptacle with filler material;

placing the filled receptacles in a mold with the receptacle open ends abutting against preformed cutter locations in the mold;

forming a PCD bit body as a complement to the mold; and infiltrating the PCD bit body with a binder creating a bond between the body and the receptacles.

2. A method as recited in claim 1 further comprising the step of forming the thin walled receptacle.

3. A method as recited in claim 2 further comprising the step of coating the thin walled receptacle with a brazing compatible coating.

4. A method as recited in claim 1 wherein the filling step comprises filling a thin walled receptacle made from a material selected from the group of materials consisting of steel and nickel.

5. A method as recited in claim 1 wherein the filling step comprises filling a bimetal alloy thin walled receptacle.

6. A method as recited in claim 1 wherein the filling step comprises filling a layered alloy thin walled receptacle having an outer layer formed from an infiltration compatible material and an inner layer formed from a brazing compatible material.

7. A method as recited in claim 6 wherein the filling step comprises filling a thin walled receptacle having a steel outer layer and a nickel inner layer.

8. A method as recited in claim 1 wherein the filling step comprises filling a receptacle having a thickness of about 0.2 mm.

9. A method as recited in claim 1 wherein the filling step comprises filling a thin walled receptacle with granular or solid filler material.

10. A method as recited in claim 1 wherein the filling step comprises filling the receptacle with a material selected from the group consisting of clay, sand and graphite.

11. A method as recited in claim 1 wherein the filling step comprises filling the receptacle with a granular filler material coated with a resin, the method further comprising the step of heating the filled receptacles and melting the resin for bonding the material.

12. A method as recited in claim 11 further comprising the step of decomposing the resin to debond the filler material.

13. A method as recited in claim 1 further comprising the steps of:

removing the filler material from the receptacles after infiltrating the bit body;

inserting PCD cutters in the receptacles; and brazing the PCD cutters to the receptacles.

14. A method as recited in claim 13 further comprising the steps of:

determining if a receptacle has deformed; and reforming the deformed receptacle.

15. A method as recited in claim 1 wherein the forming a thin walled receptacle step comprises the step of forming a thin walled receptacle having an anchor.

* * * * *